US005080550A

United States Patent [19]

Helbert

[11] Patent Number: 5,080,550

[45] Date of Patent: Jan. 14, 1992

[54] INDUSTRIAL PALLET LOADING PROCESS

[76] Inventor: Ralph E. Helbert, 348 Knollwood Dr., Anderson, S.C. 29625

[21] Appl. No.: 548,579

[22] Filed: Jul. 5, 1990

[51] Int. Cl.[5] ..... B66F 9/12

[52] U.S. Cl. ..... 414/786; 414/667

[58] Field of Search ..... 414/664, 667, 668, 671, 414/785, 786, 788; 294/87.1

[56] References Cited

U.S. PATENT DOCUMENTS

| | | | |
|---|---|---|---|
| 1,457,639 | 6/1923 | Straight | 414/671 |
| 2,985,328 | 5/1961 | Fitch | 414/667 |
| 3,353,697 | 11/1967 | Martin et al. | 414/785 X |
| 3,760,966 | 9/1973 | James, Jr. et al. | 414/785 |
| 3,870,356 | 3/1975 | Meads | 414/671 X |
| 4,239,446 | 12/1980 | Vucinic | 414/785 |

FOREIGN PATENT DOCUMENTS

| | | | |
|---|---|---|---|
| 3400916 | 7/1985 | Fed. Rep. of Germany | 414/607 |
| 677102 | 11/1964 | Italy | 414/667 |
| 52-1850 | 1/1977 | Japan | 414/671 |
| 1011496 | 4/1983 | U.S.S.R. | 414/671 |
| 1279946 | 12/1986 | U.S.S.R. | 414/664 |

*Primary Examiner*—David A. Bucci
*Assistant Examiner*—Robert S. Katz
*Attorney, Agent, or Firm*—Cort Flint

[57] ABSTRACT

An industrial process is disclosed for increasing the production and efficiency of handling palletized material (D, E) by an industrial forklift truck (10) in which a left and right fork (A, B) are spread and inserted simultaneously on outer sides (26a) of center beams (26). The forks are then moved together to squeeze the pallets together for balancing and simultaneous handling.

4 Claims, 2 Drawing Sheets

Fig. 3.
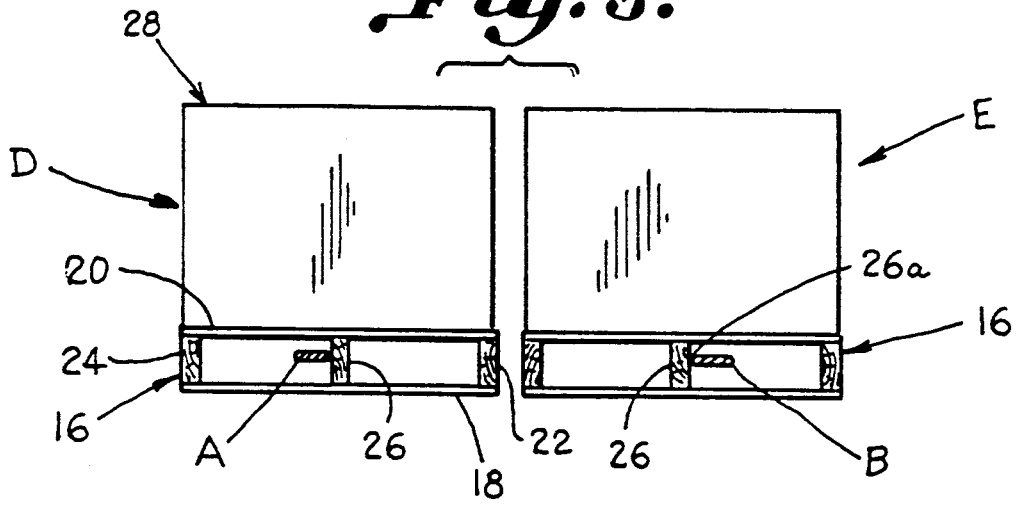
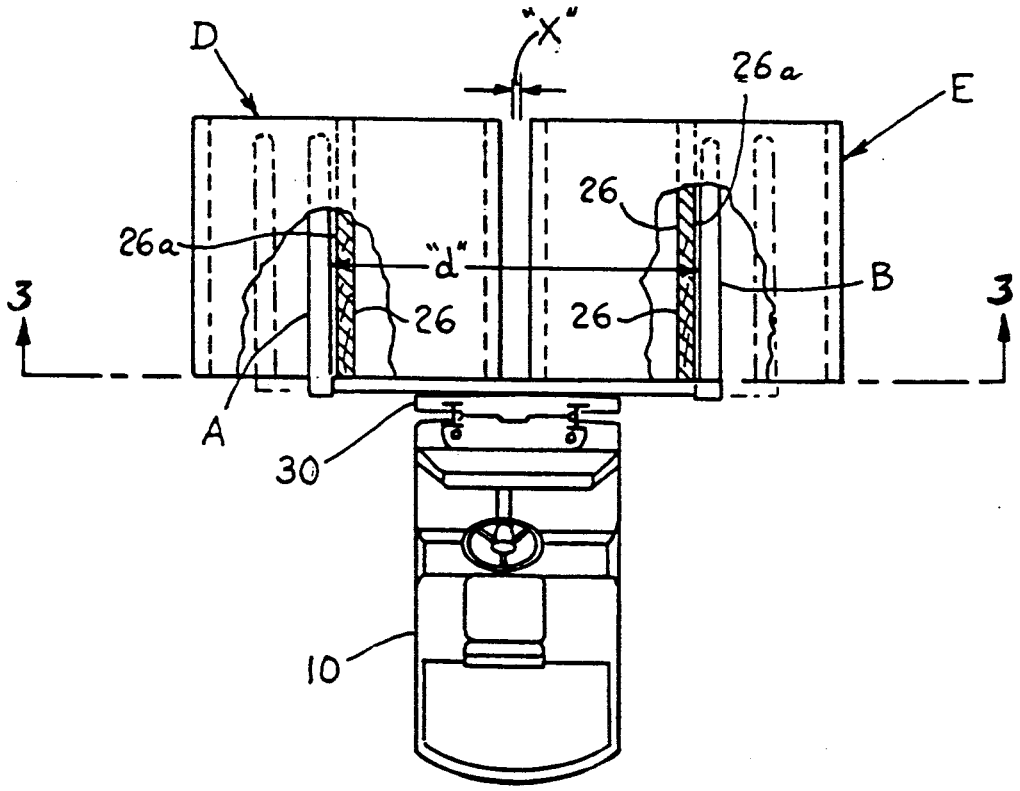
Fig. 2.

INDUSTRIAL PALLET LOADING PROCESS

BACKGROUND OF THE INVENTION

The invention relates to the handling of palletized material with light industrial forklift trucks. Light industrial forklift trucks with a rated capacity of 3500–6000 pounds typically include a pair of outwardly extending forks. The lift trucks may be equipped with standard fixed forks or optional moveable forks which may be adjusted in spacing in a horizontal plane. The typical industrial pallet is constructed from wood and has a base platform, a loading platform, side walls, and a center beam. The fronts and backs of the platform are open to permit entry of the forks. In the typical industrial process of handling palletized material, the forks are inserted on opposing sides of the center beam and the pallet is raised and lowered for loading, unloading, and transportation of the palletized material. In the handling of palletized material on loading docks, such as loading and unloading from a trailer, the handling of a single pallet material by one forklift is time consuming.

U.S. Pat. No. 3,870,356 discloses a material handling fork which includes a plurality of tines suspended on a frame wherein the tines may handle two or more pallets at one time. The tines adjust horizontally to set the pallets down with additional spacing so that they may be later picked up by conventional lift truck. However, the frame for lifting two or more pallets is not suitable for use on a lift truck, particularly a light industrial type lift truck. U.S. Pat. No. 4,280,781 discloses a forklift truck having tines between which the horizontal distance may be regulated.

Accordingly, an object of the invention is to provide a process for increasing the work capacity of industrial forklifts having two forks.

Another object of the invention is to provide an industrial process for handling palletized material in which the material handling capacity is double.

Another object of the invention is to provide a process for handling palletized material on a light industrial truck lift having two forks which doubles the workload capacity of the truck.

SUMMARY OF THE INVENTION

The above objectives are accomplished according to the present invention by providing an industrial process for handling palletized material with a lift truck having a left fork and a right fork wherein the palletized material is arranged in a first pallet assembly including a first pallet and a first load, and a second palletized assembly having a second pallet and a second load. The first and second palletized assemblies are arranged in a juxtaposed position and the process comprises moving the left and right forks away from each other so that the left fork is on the outside of a center beam of the first pallet and the right fork is on the outside of a center beam of the second pallet. The left and right forks are moved towards each other to engage the center beams and squeeze the pallet assemblies together until they contact one another slightly, and then the pressure of the left and right forks against the center beam is released. The left and right pallet assemblies are then balanced against each other and lifted until the pallet assemblies are clear of the floor. The lifted pallet assemblies are moved by the lift truck to a desired location.

DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein:

FIG. 2 is a front view of a pair of loaded pallets illustrating the process of the present invention; and FIG. 3 is a top plan view illustrating an industrial lift truck handling a pair of loaded pallets in accordance with the process of the present invention.

DESCRIPTION OF A PREFERRED EMBODIMENT

Figure 1:
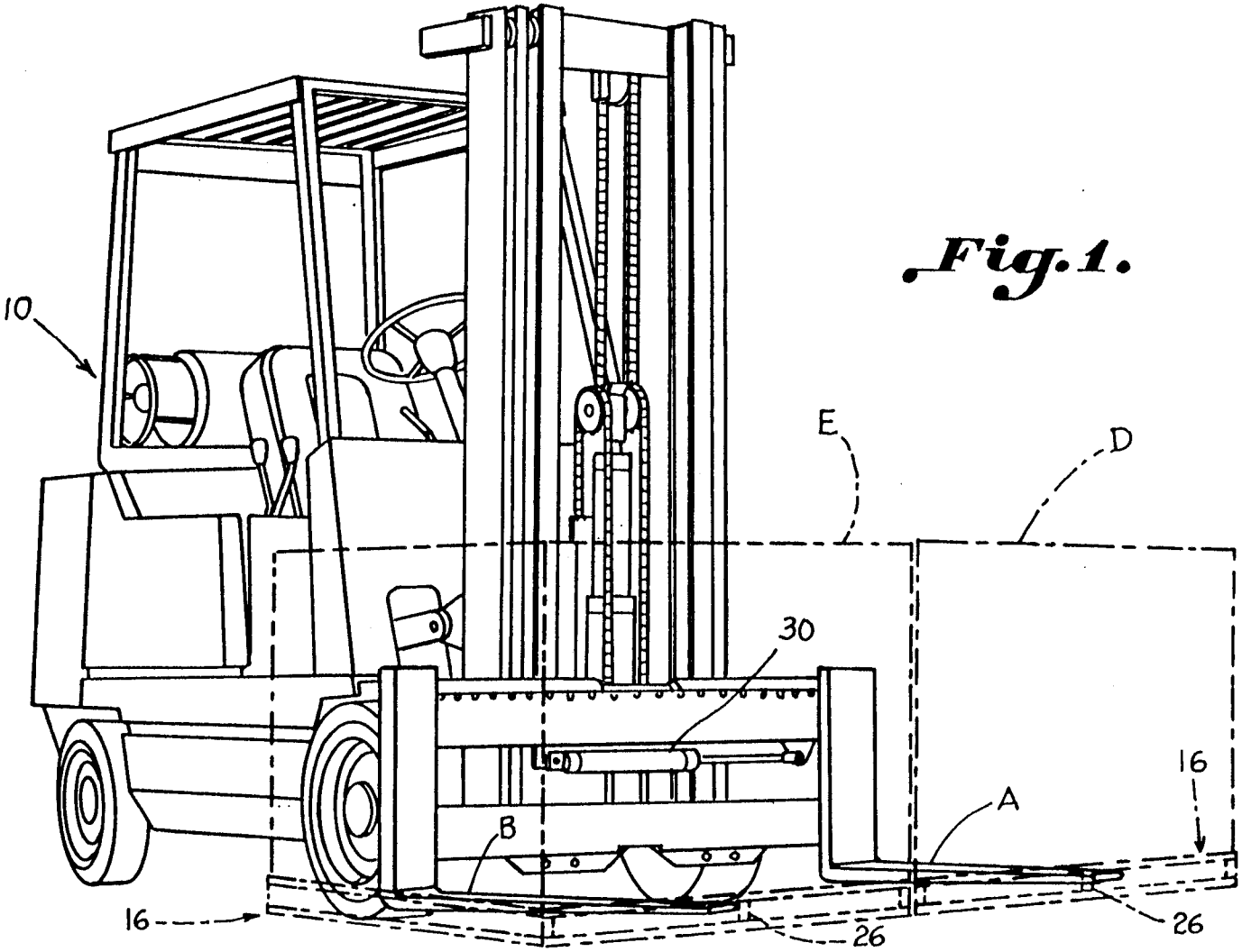
FIG. 1 is a perspective view illustrating an industrial process of handling palletized material with a lift truck according to the invention.

Referring now in more detail to the drawings, as can best be seen in FIG. 1, an industrial lift truck 10 is illustrated which may be an electric or internal combustion truck having a fork assembly with a left fork A and a right fork B. For example, reference is made to lift trucks manufactured by Clark Equipment Company of Lexington, Ky., designated as the GCX and ECS series which have a rated capacity from 3500–6000 pounds, referred to herein as light industrial lift truck. This type of lift truck is commonly used on loading docks and the like for loading an unloading palletized material from truck trailers and the like, and for loading and unloading palletized material from storage racks. Illustrated is a first loaded pallet assembly D of palletized material and a second loaded pallet assembly E of palletized material. Each pallet assembly includes a pallet 16 having a base 18, a load surface 20, a first side wall 22, a second side wall 24, and a center beam 26. On pallet 16 is a stack of material 28 which may or may not be attached to the pallet. In accordance with the invention, lift truck 10 is equipped with an optional side shifting mechanism 30 which enables fork A and fork B to be moved horizontally and shifted laterally to vary the distance "d" between the forks. A suitable mechanism is sold by Brudi Equipment Co. of Kelso, Wash.

Referring now to the drawings, an industrial process in accordance with the invention for increasing the productivity and handling of palletized material will now be described. Loaded pallet assemblies D and E are disposed generally side by side, as can best be seen in FIG. 3. Lift truck 10 is moved into a position so that forks A and B are disposed on the outer sides of center support beams 26 of respective pallet assemblies D and E. At this time, forks A and B are spread a distance "d" apart, as can best be seen in FIG. 2. Side shift mechanism 30 is operated to move forks A and B towards each other to squeeze pallet assemblies D and E together with a spacing "X" between the pallet assemblies. In this manner, pallet assemblies D and E are balanced against each other and lift truck 10 may simultaneously lift the pallet assemblies together. Loaded pallet assemblies D and E may be transported and loaded on a trailer, storage rack, or other desired location. Pallet assemblies D and E will be stabilized while lifted by forks A and B due to their proximity to each other. That is, any tendency of the pallets to roll to the left or to the right will be stabilized by the palletized loads contacting one another. Little or no pressure of the forks A and B will be needed against center support beams 26 in normal handling. However, if it becomes necessary to stabilize the pallets, slight pressure of forks A and B against the outer sides 26A of beams 26 may be provided.

Thus, it can be seen that an advantageous industrial process for handling palletized material can be had in accordance with this invention in which the productivity and handling of palletized material is improved 100%. For example, the time for unloading and reloading a truck trailer on a loading dock is cut in half. Since typically, pallet assemblies are placed side by side in multiples of two or more, the process of the invention lends itself to complete and efficient loading and unloading of such palletized assemblies. Palletized assemblies unloaded from a trailer may be transported and stacked on racks, etc., with the same expediency and efficiency as they are unloaded or loaded on the trailer.

While a preferred embodiment of the invention has been described using specific terms, such description is for illustrative purposes only, and it is to be understood that changes and variations may be made without departing from the spirit or scope of the following claims.

What is claimed is:

1. An industrial process for handling palletized material with a lift truck having a left fork and a right fork wherein the palletized material is arranged in a first pallet assembly including a first pallet and a first load, and a second palletized assembly having a second pallet and a second load, said first and second palletized assemblies being arranged in a juxtaposed position, said first and second pallets each having first and second side walls extending longitudinally along first and second sides of said pallets and a center beam extending longitudinally generally down the center between the first and second side walls of each of said pallets, wherein said process comprises:

inserting said left and right forks on said outer sides of said center beam of said first and second pallets with the spacing of said left and right forks being set at a first distance;

moving said inserted left and right forks towards each other so that said left and right forks are spaced apart a second prescribed distance, and the second side of said first pallet is at least in a close proximity to the first side of said second pallet so that said first and second pallets are maintained in a balanced condition on said left and right forks by abutment of said second pallet's first wall and first pallet's second wall with one another for stabilizing said pallet assemblies for lifting; and simultaneously lifting said first and second pallet assemblies with said left and right forks on said outer sides of said center beams of said first and second pallets.

2. The process of claim 1 including transporting said lifted palletized assemblies lifted on said lift truck to a desired location.

3. An industrial process for handling palletized material with a lift truck having a left fork and a right fork wherein the palletized material is arranged in a first pallet assembly including a first pallet and a first load, and a second palletized assembly having a second pallet and a second load, said first and second palletized assemblies being arranged in a juxtaposed position, wherein said process comprises:

moving said left and right forks away from each other so that the left fork is on the left side of a center beam of said first pallet and said right fork is on the right side of a center beam of said second pallet;

moving said left and right forks towards each other so that said pallet assemblies are squeezed together until they contact one another slightly;

releasing the pressure of said left and right forks against said center beam; and lifting said left and right forks until said pallet assemblies are clear of the floor.

4. The process of claim 3 including moving said lifted pallet assemblies by moving said lift truck to a desired location.

* * * * *